US005916064A

United States Patent [19]

Eschenbach

[11] Patent Number: 5,916,064

[45] Date of Patent: Jun. 29, 1999

[54] COMPACT EXERCISE APPARATUS

[76] Inventor: Paul William Eschenbach, 143 Lakeland Ave., Moore, S.C. 29369

[21] Appl. No.: 08/966,678

[22] Filed: Nov. 10, 1997

[51] Int. Cl.[6] ..... A63B 69/16; A63B 22/04

[52] U.S. Cl. ..... 482/51; 482/70; 482/57

[58] Field of Search ..... 482/51–53, 57, 482/70, 71, 79, 80, 62, 111, 72, 60

[56] References Cited

U.S. PATENT DOCUMENTS

| | | | |
|---|---|---|---|
| 3,724,844 | 4/1973 | Olmstead | 482/61 |
| 5,423,729 | 6/1995 | Eschebach | 482/51 |
| 5,529,555 | 6/1996 | Rodgers | 482/57 |
| 5,573,480 | 11/1996 | Rodgers | 482/51 |
| 5,577,985 | 11/1996 | Miller | 482/57 |
| 5,782,722 | 7/1998 | Sands et al. | 482/70 |

FOREIGN PATENT DOCUMENTS

| | | | |
|---|---|---|---|
| 2919-494 | 5/1979 | Germany | 482/51 |

*Primary Examiner*—S. R. Crow

[57] ABSTRACT

A compact standup exercise apparatus simulates walking and jogging with arm exercise. Elongate foot pedals move with a back and forth elliptical movement while the pedals incline. Several foot positions are provided on the elongate pedals. Arm exercise is coordinated with the motion of the foot pedals. An adjustable connector link is provided to relocate the arm exercise for different foot positions on the elongate pedals. Leg joint impact is controlled to be very low as to allow extended exercise without joint soreness.

19 Claims, 2 Drawing Sheets

COMPACT EXERCISE APPARATUS

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large complicated exercise machines. There is a need for a compact exercise machine capable of a similar elliptical strides without complexity. Further, there is a need to adjust the limits of the arm movement with arm exercise coordinated with the stride.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pats. No. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika, Ala. where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

A Passive-Motion Walking-Machine is shown by Blend in U.S. Pat. No. 219,439 having foot pedals guided by rollers which follow a curved track. Both front and rear pivots follow the same path as the foot pedal moves forward until the front rollers reach a switch plate at the forward end of the pedal cycle. The front rollers move up the inclined switch plate to roll over the rounded end to drop upon a lower track to begin the return cycle to the rear. Since the front rollers use the same track or guide path as the rear rollers through most of the pedal cycle, the pedal pivots are not guided by two separate different pivot guide curves. Furthermore, the switch plate is unidirectional for a non-reversable pedal cycle.

Recently, numerous large elliptical exercise machines have appeared in the patent literature. Rogers, Jr. in U.S. Pat. Nos. 5,527,246, 5,529,555, 5,540,637, 5,549,526, 5,573,480, 5,591,107, 5,593,371, 5,593,372, 5,595,553, 5,611,757 and 5,637,058 shows elliptical pedal motion by virtue of various reciprocating members and geared linkage systems. Miller in U.S. Pat. Nos. 5,518,473, 5,562,574, 5,611,756, 5,518,473, 5,562,574 and 5,577,985 also shows elliptical pedal motion using reciprocating members and various linkage mechanisms along with oscillating guide links with control links to determine pedal angles.

The Elliptical Cross Trainer by Life Fitness of Franklin Park, Ill., recently introduced to the Club Industry in San Francisco during April, 1997, also generates elliptical pedal motion using an elongated pedal supported by rollers on one end and an offset crank mechanism on the other end. None of these elliptical exercise machines anticipate a simple compact exercise machine having adjustable arm exercise coordinated with the stride.

Eschenbach in U.S. Pat. Nos. 5,352,169 and 5,529,554 shows a collapsible elliptical exercise apparatus that is compact but does not include arm exercise coordinated with the pedal motion.

It is one objective of this invention to provide a compact linkage system that causes the pedal to move with a back and forth elliptical stride coordinated with adjustable arm exercise. Another object of this invention is to provide elongate pedals that have several foot positions to simulate different walking or jogging exercise.

There is a need for a pedal operated compact exercise machine that can be safely operated in the standup position whereby the arms and legs can be exercised with the feet moving through a generally elliptical path while the pedals move with a smoothly changing angular motion during the pedal cycle.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong curve motion while pedal angles are controlled to vary about the horizontal during the pedal cycle. Arm exercise is by arm levers coordinated with the mechanism guiding the foot pedals.

In the preferred embodiment, the apparatus includes a separate elongate pedal for each foot having several positions for the foot, each elongate pedal being supported by a crank on one end and by a roller on the other end. The crank completes one full revolution during a pedal cycle and is phased generally opposite the crank for the other elongate pedal through a bearing journal attached to the framework. The roller is guided by a lateral structural member which is part of the framework under the elongate pedal and generally parallel to the elongate pedal. The lateral structural member is attached on one end to a forward structural member and to a rearward structural member at the other end. The forward and rearward structural members are configured to be supported by the floor.

An upright support is attached to the forward structural member to provide pivots for arm levers. An adjustable connector link couples the arm levers to the elongate pedals near the rollers. As the foot of the user is moved forward or rearward on the elongate pedal, the connector link can be adjusted to reposition the arm levers as desired by the operator.

In this embodiment, the elongate pedal is moved by the foot of the user where the pedal follows an oblong curve path while one end of the elongate pedal moves back and forth relative to the lateral structural member. The connector link moves the lower end of the arm lever in the same direction as the foot while the upper end of the arm lever moves in the direction opposite the foot due to the arm lever pivot located intermediate the ends.

Load resistance is applied to the crank in this embodiment by a pulley which drives a belt to a smaller pulley attached to an air fan flywheel supported by the framework. A change in speed of the crank provides variable intensity exercise for the operator. It should be understood that other forms of load resistance such as magnetic, alternator, friction belt or others may be applied to the crank.

In summary, this invention provides the operator with several foot positions having stable foot pedal support that simulate walking and jogging with very low joint impact in a compact simple exercise machine with coordinated adjustable arm exercise.

DETAILED DESCRIPTION OF THE EMBODIMENTS

Figure 1:
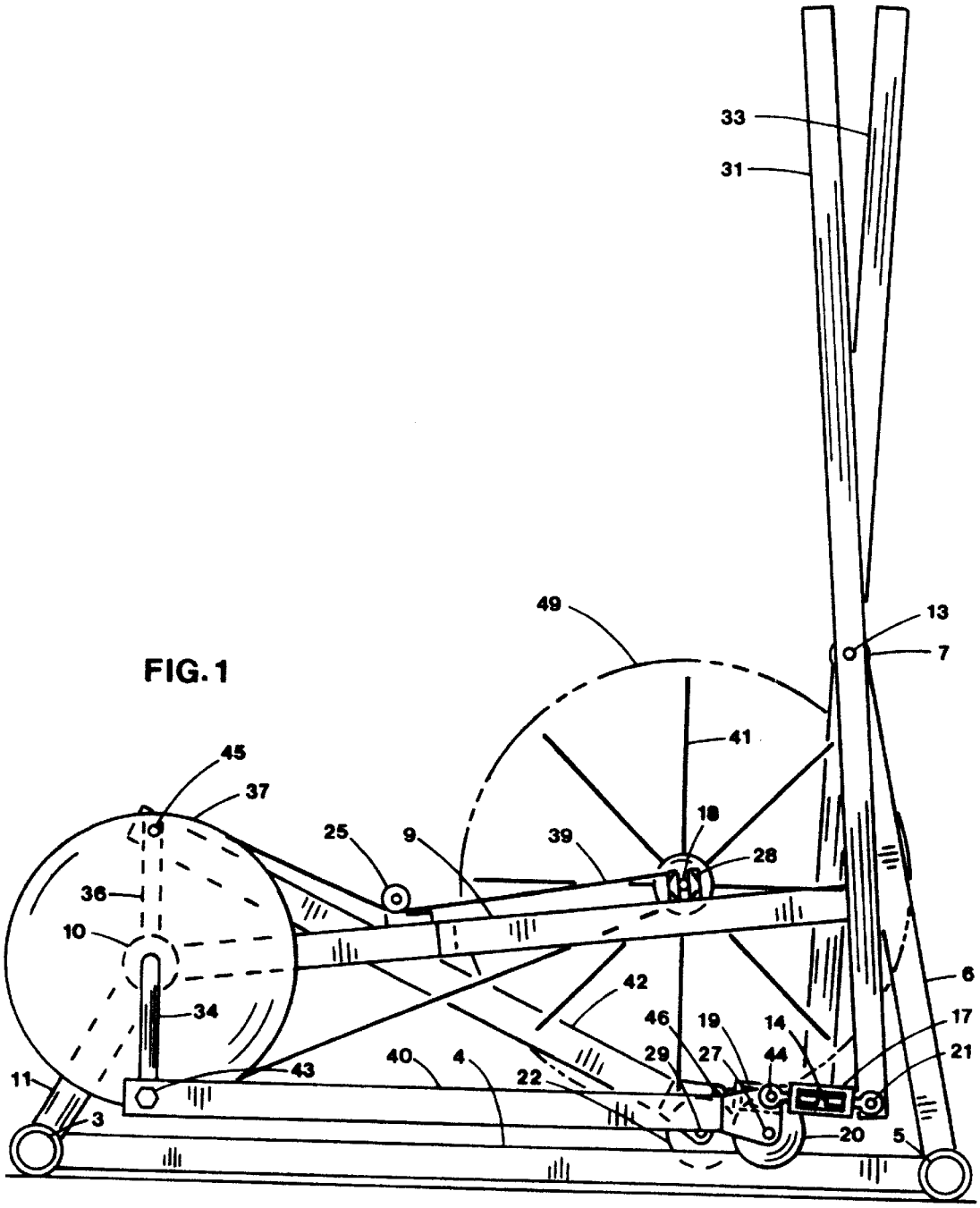
FIG. 1 is a right side elevation view of the preferred embodiment of an exercise machine constructed in accordance with the present invention.
Figure 2:
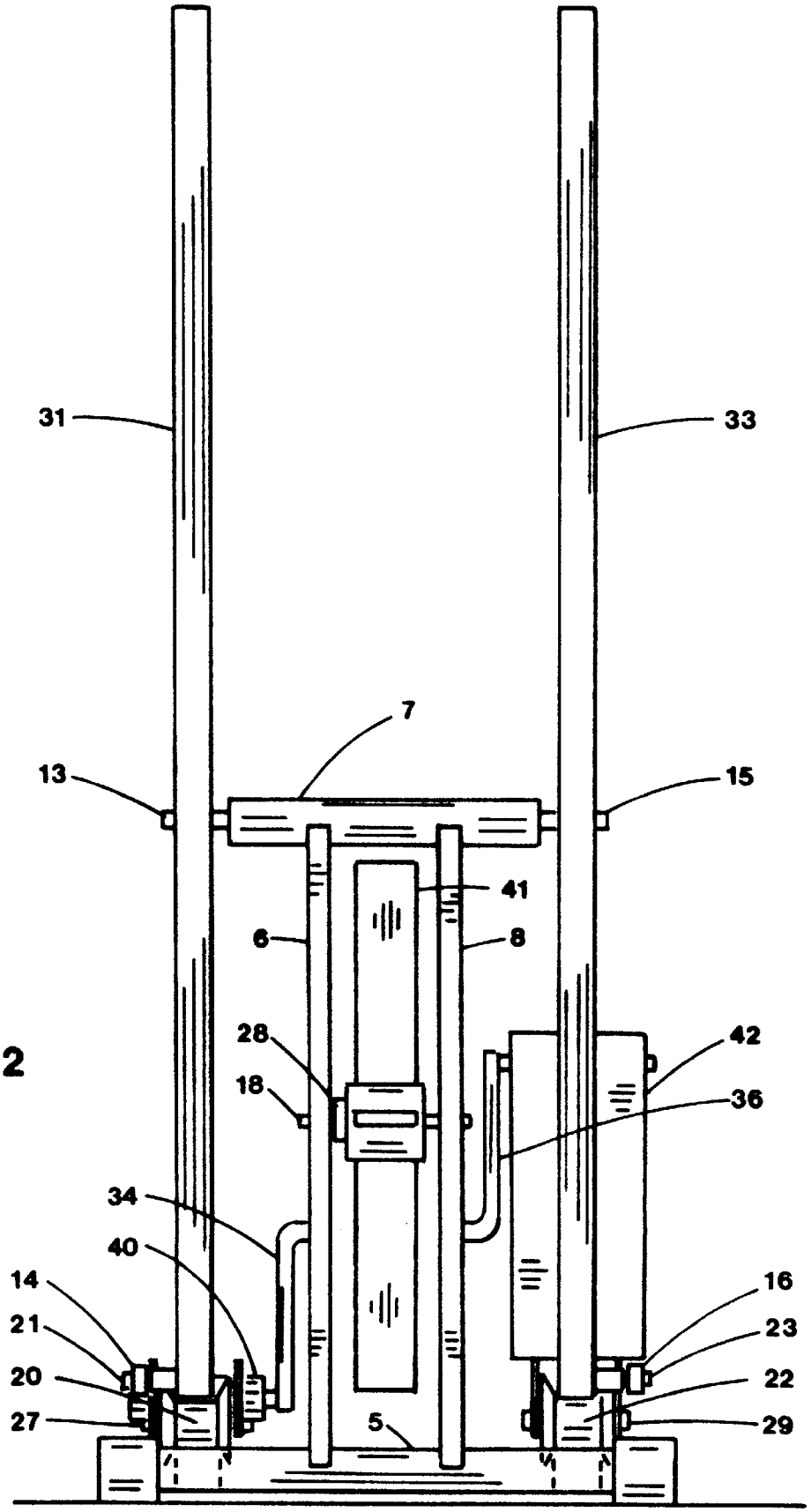
FIG. 2 is the front view of the preferred embodiment shown in FIG. 1.

Referring to the drawings in detail, elongate pedals 40 and 42 are shown in FIGS. 1 and 2 in the lowermost and uppermost positions of the preferred embodiment. Elongate pedals 40 and 42 have several foot positions and are attached to rollers 20,22 at pivots 27,29 at one end and supported by crank pivots 43,45 at the other end. Cranks 34,36 are joined inside bearing housing 10 and protrude outwardly in generally opposing directions.

Lateral structural members 2,4 guide rollers 20,22 in a back and forth direction generally parallel to the elongate pedals 40,42. Arm levers 31,33 are pivoted to upright crossover member 7 at pivots 13,15 and extend downward towards elongate pedals 40,42. Connector links 14,16 couple the arm levers 31,33 at pivots 21,23 to elongate pedals 40,42 at pivots 44,46. Connector links 14,16 are adjustable in length by turnbuckles 17,19. When the predetermined length of the connector links 14,16 is adjusted longer, the upper portion of arm levers 31,33 move rearwards where the operator has the feet closer to the crank 34,36. Conversely, shorter connector links 14,16, move the operator more forward on elongate pedals 40,42.

Lateral structural members 2,4 connect forward structural member 5 and rearward structural member 3 which contact the floor for support of the exercise machine. Upright support members 6,8 connect forward structural member 5 to crossover member 7 while frame member 9 connects crossover member 7 to bearing housing 10 which is connected to rearward structural member 3 by frame member 11.

Load resistance is imposed upon cranks 34,36 by pulley 37 which drives air fan flywheel 41 by belt 39, with tension pulley 25, coupled to pulley 28 which is supported by the frame at shaft 18. The air fan flywheel 41 is covered by shroud 49.

Application of body weight on the pedals 40,42 causes the pedals 40,42 to follow elliptical curves with rollers 20,22 moving forward and rearward along lateral structural members 2,4 and together with force applied at the arm levers 31,33 cause the linkage to rotate the air fan flywheel 41 for a gain in momentum. This air fan flywheel 41 momentum will carry the linkage system through any dead center positions of the crank 34,36. The pedals 40,42 and arm levers 31,33 can be operated to drive the air fan flywheel 41 in either direction of rotation.

In summary, the present invention has distinct advantages over prior art because the back and forth elliptical stride movement of the feet can be changed by relocating the foot on the elongate pedal while adjustment is provided to relocate the arm levers as desired by the operator to be coordinated with the stride movement.

What is claimed is:

1. An exercise machine comprising;

a framework means, said framework means being configured to be supported by the floor and including a lateral structural member means;

a crank means pivotally connected to said framework means rearward the operator, said crank means projecting outwardly therefrom on both sides thereof;

an elongate pedal means to support each foot, said elongate pedal means pivotally connected proximate one end to said crank means and operably associated with said lateral structural member means proximate the other end forward said operator;

an arm lever means, said arm lever means pivotally connected to said framework means;

a connector link means, said connector link means pivotally connected to the front end of said elongate pedal means forward said operator and to said arm lever means;

said lateral structural member means configured to guide one end of said elongate pedal means with a generally back and forth movement forward said operator to allow said elongate pedal means to move relative to said framework means when the foot of the user is rotating said crank means whereby said connector link means articulates forward the operator and causes said arm lever means to move in coordination with said elongate pedal means.

2. The exercise machine according to claim 1 wherein said lateral structural member means is positioned horizontal to the floor.

3. The exercise machine according to claim 1 further comprising a roller means, said roller means pivotally attached to said elongate pedal means forward said operator and being in rolling contact with said lateral structural member means.

4. The exercise machine according to claim 1 wherein said connector link means is adjustable to reposition the location of said arm lever means relative to the user.

5. The exercise machine according to claim 3 wherein said connector link means is attached to said elongate pedal means proximate said roller means.

6. The exercise machine according to claim 1 further comprising a load resistance means operably associated with said crank means.

7. The exercise machine according to claim 1 wherein said arm lever means is pivotally connected to said framework means whereby the pivot connection is positioned intermediate the ends of said arm lever means.

8. The exercise machine according to claim 1 wherein said elongate pedal means further comprises a first foot position proximate said crank means and a second foot position proximate said connector link means whereby the foot experiences different motion in each said foot position.

9. An exercise machine comprising;

a framework means, said framework means being configured to be supported by the floor and including a lateral structural member means;

a crank means pivotally connected to said framework means rearward the operator, said crank means projecting outwardly therefrom on both sides thereof;

an elongate pedal means to support each foot, said elongate pedal means pivotally connected proximate one end to said crank means and operably associated with said lateral structural member means proximate the other end forward said operator;

an upright support means, said upright support means connected to said framework means;

an arm lever means, said arm lever means pivotally connected with said upright support means;

a connector link means, said connector link means pivotally connected forward said operator to said elongate pedal means and to said arm lever means;

said lateral structural member means configured to guide one end of said elongate pedal means forward said operator, with a generally back and forth movement to allow said elongate pedal means to move relative to said framework means when the foot of the user is rotating said crank means whereby said elongate pedal means is generally parallel to said lateral structural member means when said crank means is proximate said lateral structural member means.

10. The exercise machine according to claim 9 wherein said lateral structural member means is positioned horizontal to the floor.

11. The exercise machine according to claim 9 further comprising a roller means, said roller means pivotally attached to said elongate pedal means forward said operator and being in rolling contact with said lateral structural member means.

12. The exercise machine according to claim 9 wherein said connector link means is adjustable to reposition the location of said arm lever means relative to the user.

13. The exercise machine according to claim 11 wherein said connector link means is attached to said elongate pedal means proximate said roller means.

14. The exercise machine according to claim 9 further comprising a load resistance means operably associated with said crank means.

15. An exercise machine comprising;

a framework means, said framework means being configured to be supported by the floor;

a crank means pivotally connected to said framework means rearward the operator, said crank means projecting outwardly therefrom on both sides thereof;

a guide means, said guide means attached to said framework means;

an elongate pedal means to support each foot, said elongate pedal means pivotally connected proximate one end to said crank means and operably associated with said guide means proximate the other end forward said operator;

an arm lever means, said arm lever means pivotally connected to said framework means;

an adjustable connector link means having a predetermined length, said adjustable connector link means pivotally connected forward said operator to said elongate pedal means and to said arm lever means;

said guide means configured to support the forward end of said elongate pedal means with a generally back and forth movement to allow said elongate pedal means to move relative to said framework means when the foot of the user is rotating said crank means whereby said adjustable connector link means causes said arm lever means to move in coordination with said elongate pedal means.

16. The exercise machine according to claim 15 wherein said elongate pedal means further comprises a first foot position proximate said crank means and a second foot position proximate said connector link means whereby the foot experiences different motion in each said foot position.

17. The exercise machine according to claim 15 further comprising a roller means, said roller means pivotally connected to the forward end of said elongate pedal means opposite said crank end whereby said roller means is supported by said guide means for generally back and forth movement.

18. The exercise machine according to claim 17 wherein said adjustable connector link means is attached to said elongate pedal means proximate said roller means.

19. The exercise machine according to claim 15 further comprising a load resistance means operably associated with said crank means.

* * * * *